United States Patent [19]

Supra

[11] Patent Number: 4,876,001

[45] Date of Patent: Oct. 24, 1989

[54] APPARATUS FOR USE WITH A POOL CLEANER

[75] Inventor: Carl F. W. Supra, Ranburg, South Africa

[73] Assignee: Liberty Pool Products S.A., Switzerland

[21] Appl. No.: 34,986

[22] Filed: Apr. 6, 1987

[30] Foreign Application Priority Data

Apr. 4, 1986 [ZA] South Africa ..... 86/2501
Apr. 23, 1986 [ZA] South Africa ..... 86/3024

[51] Int. Cl.[4] ..... E04H 3/20

[52] U.S. Cl. ..... 210/123; 210/136; 210/169; 137/433; 137/114; 4/507; 4/512

[58] Field of Search ..... 210/98, 123, 125, 169, 210/119, 136; 4/507–510, 363, 512; 137/433, 430, 114

[56] References Cited

U.S. PATENT DOCUMENTS

| | | | |
|---|---|---|---|
| 2,979,206 | 5/1958 | Konopka et al. | 210/169 |
| 3,067,879 | 12/1962 | Baker | 210/169 |
| 3,478,882 | 11/1969 | Hörnemann | 210/169 |
| 3,508,661 | 4/1970 | Diemond et al. | 210/169 |
| 3,555,574 | 8/1969 | Stanwood | 210/169 |
| 3,567,020 | 3/1971 | Whitaker | 210/169 |
| 3,616,916 | 10/1969 | Greene | 210/169 |
| 3,620,372 | 11/1971 | Ehret | 210/169 |
| 3,628,664 | 12/1971 | Stanwood | 210/169 |
| 4,606,365 | 8/1986 | Siposs | 137/433 |
| 4,725,352 | 2/1988 | Haliotis | 210/169 |

*Primary Examiner*—Richard V. Fisher
*Assistant Examiner*—Coreen Y. Lee
*Attorney, Agent, or Firm*—Lowe, Price, Leblanc, Becker & Shur

[57] ABSTRACT

Apparatus for use with a swimming pool cleaner which includes a housing which defines a chamber, at least one inlet to the chamber and an outlet from the chamber, and a bouyant ball inside the chamber. The apparatus is installed or incorporated in a weir. When suction is cyclically applied to the outlet, and removed, the ball alternately blocks the outlet, and leaves the outlet unblocked. Correspondingly the pool cleaner is operated to clean a submerged surface of a swimming pool, or water is drawn directly from the pool and through a weir, for filtration. A more efficient cleaning of the pool takes place.

12 Claims, 2 Drawing Sheets

APPARATUS FOR USE WITH A POOL CLEANER

BACKGROUND OF THE INVENTION

This invention relates generally to the cleaning of swimming pools and more particularly to the cleaning of pools with the aid of a suction-type pool cleaner.

Pool cleaners of the kind described are usually connected to the suction outlet of a weir which is installed as essential equipment to ensure adequate filtration and cleaning of the water in the pool. The weir is normally fitted with a sieve basket and with the filtration circuit in operation, and in the absence of a pool cleaner, the sieve basket traps debris and foreign material which is above a certain size and which is suspended in the water.

When a pool cleaner is fitted to an installation of this type material suspended in the water is not readily filtered. The reason for this is that pool cleaners which are known to the applicant clean only the submerged surfaces of the pool and consequently it is only dirt and foreign material which have settled on such surfaces which are drawn into the filtration system.

It follows that for efficient cleaning of a pool it is necessary at regular intervals to connect the pool cleaner to the weir, and then to disconnect the pool cleaner from the weir, so that alternate cleaning cycles are achieved in which the submerged surfaces are cleaned, and in which material suspended in the water is filtered out, respectively.

SUMMARY OF THE INVENTION

It is an object of the present invention to provide apparatus which enables the alternate cleaning functions which have been described to be achieved substantially automatically.

The invention provides apparatus for use with a swimming pool cleaner which includes a housing which defines a chamber, a first opening which is formed through the wall of the housing to the chamber and which is adapted to be connected to a water suction source, at least a second opening which is formed through the wall of the housing to the chamber and which permits water flow into the chamber, and a valve member which alternately seals the first opening, and leaves the first opening unsealed, each time water commences to flow from the second to the first opening respectively.

The valve member is preferably a buoyant body. The buoyant body is drawn to the first opening by water flow and rises away from the first opening when the water flow ceases.

Means may be provided for guiding the movement of the body when it rises. The guide means may comprise formations on an inner wall of the chamber which displace the body to opposing sides of the first opening each time the body rises, respectively.

The apparatus may include a divider which is so positioned relatively to the first opening that when the body is on a first side of the divider the body is able to seal the first opening and when the body is on a second, opposing, side of the divider, the body is not able to seal the first opening.

The body is thus guided by the guide formations to alternate sides of the divider each time water flow ceases through the chamber.

A connection for a swimming pool cleaner may be provided downstream of the first opening.

The second opening may be at an upper side of the housing.

According to a different aspect of the invention there is proivded apparatus which includes a housing in which is formed a chamber, an inlet to and an outlet from the chamber being formed through a wall of the housing, the chamber in use being filled with water, guide formations which are located on an inner surface of the chamber which opposes the outlet, a buoyant body which is located inside the chamber and which, when suction is applied to the outlet, is drawn towards the outlet, and which, when suction is released, floats upwardly in the chamber to the guide formations, the guide formations being shaped to cause the body to move from one side of the divider member to an opposing side each time the suction is released so that when the suction is re-applied the body is drawn alternately to opposing sides of the suction member.

The body on one side of the divider member is able to seat on and seal the outlet while, on the opposing side of the dividing member, the body is constrained by the divider member and is unable to seat on and seal the outlet.

The apparatus of the invention may be provided separately i.e. independently of a weir or alternatively its falls within the scope of the invention to provide, in combination, a weir and apparatus of the kind described engaged with the weir or formed integrally with the weir.

When the apparatus of the invention is provided as a separate component the outlet at the lower end is connected to the outlet of the weir. A connection for a swimming pool cleaner may be provided between these two outlets. With original swimming pool installations it is desirable that a connection extends through the wall of the swimming pool to enable a permanent, or semi-permanent, coupling to the pool cleaner to be effected.

The invention also provides a method of controlling the cleaning of a swimming pool wherein water is drawn from the pool through a weir by means of a pump for filtration purposes the method including the steps of cleaning a submerged surface of the swimming pool by means of a pool cleaner with suction being produced in the pool cleaner by means of the pump, causing the pump to turn off, causing the pump to turn on, diverting the suction which is produced by the pump from the pool cleaner to a connection which draws water from the pool through the weir, causing the pump to turn off, causing the pump to turn on, diverting the suction which is produced by the pump from the connection to the pool cleaner, and repeating the aforementioned cleaning cycle.

The periods between turning the pump on and off, and off and on, can be varied, and can be controlled automatically, for example by means of a time switch.

BRIEF DESCRIPTION OF THE DRAWINGS

The invention is further described by way of example with reference to the accompanying drawings in which.

DESCRIPTION OF PREFERRED EMBODIMENT

Figure 1:
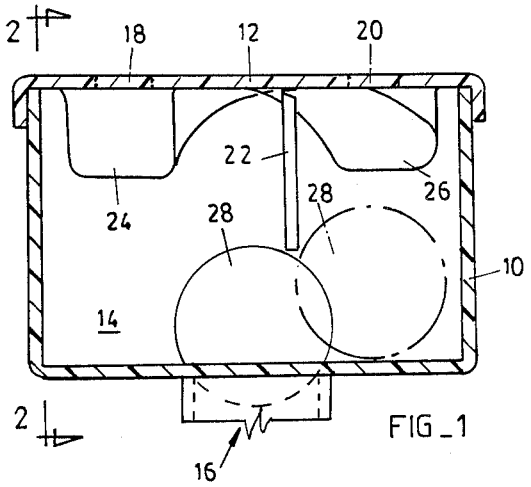
FIG. 1 is a view from a first side, partly cross-sectioned, of apparatus according to one form of the invention.
Figure 2:
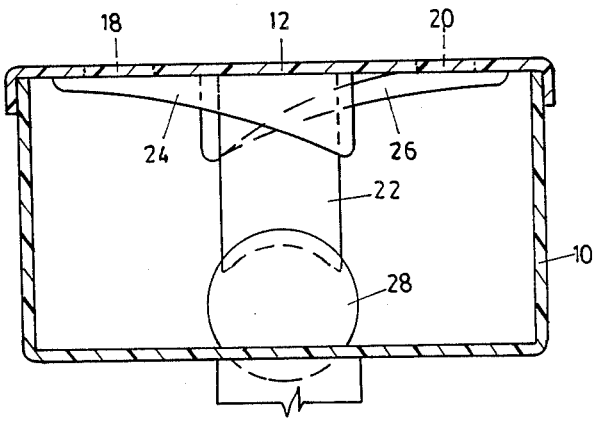
FIG. 2 is a view from a second side, at right angles to the first side, and again partly cross-sectioned, of the apparatus of FIG. 1.
Figure 3:
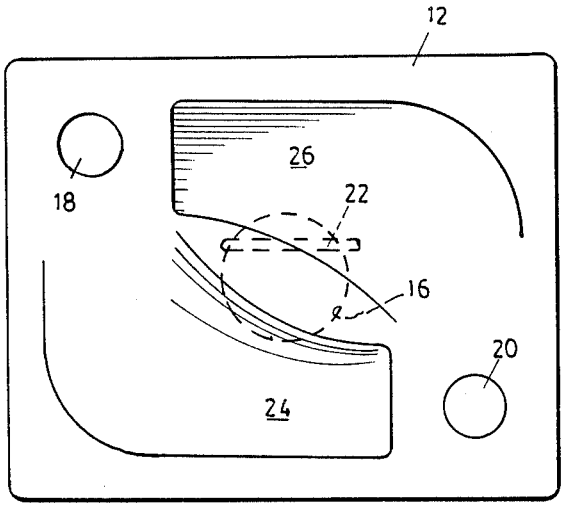
FIG. 3 is a plan view of the apparatus of FIG. 1.

FIGS. 1 to 3 illustrate apparatus according to the invention which includes a casing 10 and a lid 12 which together define a chamber 14, an outlet 16 from the chamber which is formed in a lower wall of the casing, two inlets 18 and 20 to the chamber which are formed through the lid 12, a divider member 22 which extends from the lid 12 and which opposes the outlet 16, two guide formations 24 and 26 respectively which are formed by depressions in the lid 12 and which in effect define ramps on an inner upper surface of the chamber, and a buoyant ball 28 which is located inside the chamber.

The outlet 16 is circular in outline and the ball 28 which is spherical is able to seat on and seal the outlet when it is on one side of the divider member 22.

It is to be noted, referring to FIGS. 1 and 3, that the divider member is positioned off-centre relatively to the outlet 16, and that its lower end is shaped to the curvature of the ball. Thus with the ball 28 on the left of the divider member it is possible for the ball to seat on the outlet whereas when the ball is on the opposing side of the divider member it takes up the position shown by the dotted line in FIG. 1 at which it cannot seat on and seal the outlet.

Figure 4:
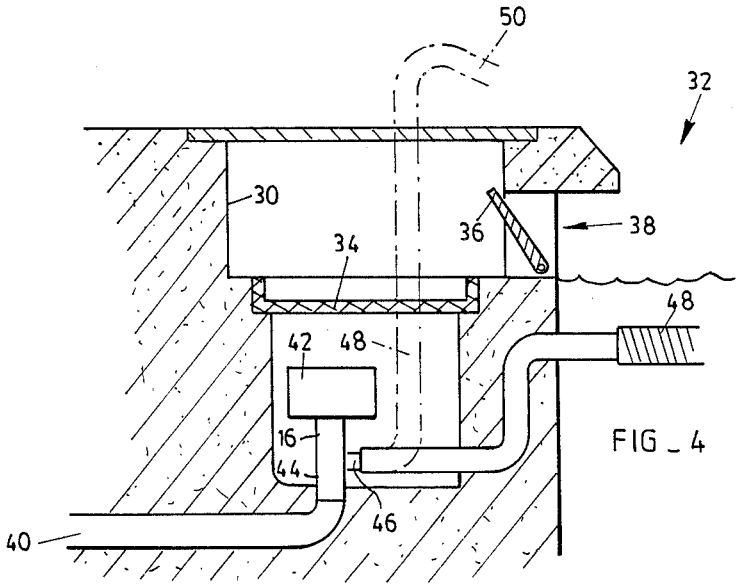
FIG. 4 is a side view, partly sectioned, of a weir incorporating the apparatus of FIG. 1.

FIG. 4 illustrates a weir 30 installed adjacent a swimming pool 32. The weir is of conventional construction and includes a removable sieve basket 34, a float 36 at its inlet 38, and a suction outlet 40 which is connected to a filtration system.

In normal operation of the weir water is drawn through the inlet 38 and large pieces of foreign material suspended in the water are trapped by the basket 34. The water passes through the outlet 40 to the filtration system and is eventually returned to the swimming pool at a remote location.

With one conventional mode of operation of a suction-type swimming pool cleaner the sieve basket 34 is removed and a flexible hose is inserted into the suction outlet 40. The flexible hose has a terminal connection to a pool cleaner which in known manner cleans submerged surfaces of the pool 32. As has been stated it is necessary, for efficient cleaning of the water, periodically to disconnect the pool cleaner from the outlet 40 so as to restore conventional cleaning operation to the weir.

In accordance with the invention the apparatus shown in FIGS. 1 to 3, and designated by the reference numeral 42 in FIG. 4, is installed in the weir with the outlet 16 connected directly to the suction outlet 40 of the weir by a short length of pipe 44. This pipe has a connector 46 which provides a connection point for a flexible pipe 48 leading to a suction-type swimming pool cleaner, not shown.

With existing swimming pools installations the flexible pipe 48 is passed through a hole which is made in the sieve basket 34 for the purpose. The pipe then passes out of the upper end of the weir into the swimming pool. This type of connection is indicated by means of a dotted line 50.

With new installations, i.e. when the apparatus of the invention is incorporated in a weir during construction of a pool, it is preferred to extend the connector 46 so that it passes through the wall 52 of the swimming pool to provide a connection for the pipe 48 which is below the water level of the pool. This does not interfere with the operation of the float 36 and it is not necessary to alter the sieve basket 34 in any way, nor for that matter the lid of the weir.

With either form of installation the operation of the apparatus is as follows. Assume that initially no water is flowing through the filtration system, in other words, assume that the pump which is incorporated in the filtration system is not operating. The chamber 14 of the apparatus is filled with water which enters through the outlet 16 and the inlets 18 and 20. The ball 28, which is buoyant, floats upwardly and strikes one of the guide formations 24 or 26, as the case may be. These formations are so shaped that the ball is guided towards one of the inlet holes 18 and 20. When the ball reaches the respective hole it engages partly with the hole and remains in position. It is to be noted, referring particularly to FIG. 3, that the holes 18 and 20 are essentially on opposing sides of the dividing member 22. Assume for example that the ball 28 initially is engaged with the hole 18. If at this point the pump is turned on water flows through the inlets 18 and 20 to the outlet 16 and entrains the ball with it so that the ball is drawn towards the outlet 16 on, in this case, the right hand side of the divider member 22, refer to FIG. 1. The ball 28 then takes up the dotted line position shown in FIG. 1 at which it does not interfere with the flow of water through the outlet 16 and consequently normal water flow can take place through the weir. The ball is held in the position shown by dotted lines in FIG. 1 by the suction created, in the chamber, at the mouth of the outlet 16. As the resistance of the water flow path from the inlet 38 to the outlet 40 of the weir is far less than the resistance of the water flow path from the swimming pool cleaner through the flexible pipe 48 to the outlet 40 substantially conventional water flow and filtration action takes place and material suspended in the body of the water can be removed by the sieve basket and by the filtration plant.

When the pump is turned off the ball rises under its natural buoyancy from the outlet 16 and strikes the guide formation 26 which steers the ball towards the hole 20. The ball is now located on the opposing side of the dividing member 22. If the pump is now turned on the ball is drawn downwardly towards the outlet 16 and assumes the position shown in FIG. 1 at which it seats on and blocks or seals the outlet 16. Water flow from the inlet 38 through the weir to the outlet 40 is thus inhibited. Thus the full suction pressure is applied to the flexible pipe 48 and the swimming pool cleaner is able to operate in its conventional manner. When the pump is again turned off the ball rises, strikes the guide formation 24, and moves to the hole 18 and the described cycle can then recommence.

It follows that each time the pump is turned off the ball is alternately guided to the inlets 18 and 20 to the chamber and each time the pump is turned on the ball is drawn to the outlet 16 but on alternate sides of the dividing member. Thus the ball alternately seals the outlet, and leaves the outlet open.

The switching on and off of the pump can of course be effected manually. However most swimming pool installations have time switches which control the operation of the pump. It is thus a simple matter to set the time switch to achieve normal filtration action, and swimming pool cleaner operation, in any desired ratio of periods of operation.

As has been stated the apparatus of the invention can be provided separately i.e. independently of a weir, or in combination with a weir, and the scope of this specification is intended to extend to both embodiments. In the latter embodiment the housing 10 is preferably formed integrally with the weir, at any suitable position on the weir, for example by means of a moulding process.

I claim:

1. Apparatus for use with a swimming pool cleaner, which includes a housing which defines a chamber, a first opening which is formed through a wall of the housing to the chamber and which is adapted to be connected to a water suction source, first and second inlets including at least a second opening which is formed through the wall of the housing to the chamber and which permits water flow into the chamber, and a valve means for alternately sealing the first opening and leaving the first opening unsealed, each time water commences to flow from the second to the first opening, respectively, said valve means including a buoyant body and means for drawing the buoyant body to the first opening by water flow and for causing the body to rise away from the first opening when the water flow ceases.

2. Apparatus according to claim 1 which further includes guide formations on an inner wall of the chamber for displacing the body to opposing sides of the first opening each time the body rises, respectively.

3. Apparatus according to claim 1 which further includes a divider inside the chamber which is so positioned relatively to the first opening that when the body is on a first side of the divider the body is positioned to seal the first opening and when the body is on a second, opposing, side of the divider, the body is prevented from sealing the first opening.

4. Apparatus according to claim 1 which includes a connection for the swimming pool cleaner downstream of the first opening.

5. Apparatus for use with a swimming pool cleaner, comprising a housing in which is formed a chamber, first and second inlets to and an outlet from the chamber being formed through a wall of the housing, the chamber in use being filled with water, guide formations which are located on an inner surface of the chamber which opposes the outlet, a buoyant body which is located inside the chamber and which, when suction is applied to the outlet, is drawn towards the outlet, and which, when suction is released, floats upwardly in the chamber to the guide formations, said first and second inlets located on opposite sides of a divider member, the guide formations comprising means for moving the body from one side of said divider member to an opposing side each time the suction is released and for causing the body to move alternately to said inlets on opposing sides of the divider member when suction is removed from and re-applied to the outlet.

6. Apparatus according to claim 5 wherein the divider member is positioned in the housing to permit the body, when on one side of the divider member, to seat on and seal the outlet while preventing the body from seating on and sealing the outlet when the body is on the opposing side of the divider member.

7. In a cleaning apparatus for a swimming pool, having a suction outlet, a first inlet for input of water for filtration and removal of suspended particles therefrom, and a second inlet for connection to a pool cleaner for cleaning of submerged surfaces of the pool, the improvement comprising:

automated alternating means for alternating cleaning and filtering operations by automatically alternating application of said suction outlet between said first inlet and said second inlet, said alternating means interposed between said suction outlet of said cleaning apparatus and said first inlet thereof; said alternating means including a chamber, said chamber having an outlet connected to said suction outlet and at least one inlet connected to receive water from said first inlet of said cleaning apparatus, said alternating means further including a valve means responsive to alternate applications of suction via said suction outlet by alternately sealing and opening said outlet, thereby alternately connecting and disconnecting said suction to said first inlet of said cleaning apparatus, said valve means comprising a buoyant structure adapted for sealing said outlet of said alternating means chamber, a barrier dividing said chamber to first and second areas, said first area selected for permitting said buoyant structure to seat on and seal said outlet when suction is applied thereto, said second area bounded by said barrier for preventing said buoyant structure from sealing said outlet, and a pair of guide means for buoyantly guiding said buoyant member from said first area to said second area and from said second area to said first area, whereby when said buoyant member is in said first area and suction is applied to said outlet said buoyant member is entrained toward said outlet and is seated thereon thereby sealing said outlet, when said buoyant member is in said first area and suction is removed from said outlet said buoyant member is buoyantly guided to said second area, when said buoyant member is in said second area and suction is applied to said outlet said buoyant member is entrained toward said outlet and is prevented by said barrier from seating thereon, and when said buoyant member is in said second area and suction is removed from said outlet said buoyant member is buoyantly guided to said first area.

8. An improved cleaning apparatus as recited in claim 7, wherein said first inlet is connected to a water flow path having a first, low, resistance for input of said water for filtration and removal of suspended particles therefrom, and said second inlet is connected via a water flow path of a second resistance, greater than said first resistance, to said pool cleaner, said alternating means operable for alternating cleaning and filtering operations by alternating connection of said suction outlet between a first connection to both of said first and second inlets and a second connection only to said second inlet, said alternating means thereby operable in said second connection for providing suction to said second inlet for operation of said pool cleaner and in said first connection for providing suction to both said first and second inlets, whereby in said first connection suction is effectively provided for said filtration and removal of suspended particles by the higher resistance of said second water flow path.

9. An improved cleaning apparatus as recited in claim 7 further including a sieve basket between said suction outlet and said first inlet thereof, wherein said inlet of said chamber is disposed in a water flow path between said sieve basket and said suction outlet.

10. An improved cleaning apparatus as recited in claim 7 wherein said pair of guide means are formed on a wall of said chamber.

11. An improved cleaning apparatus as recited in claim 7 wherein said alternating means comprises a pair of inlets in said chamber, a separate inlet being located in each of said first and second areas thereof.

12. An improved cleaning apparatus as recited in claim 7 wherein said alternating means comprises a pair of inlets in said chamber.

* * * * *